US007766272B2

(12) United States Patent
Ni

(10) Patent No.: US 7,766,272 B2
(45) Date of Patent: Aug. 3, 2010

(54) ROTATING APPARATUS FOR WINDING REEL OF HIGH-PRESSURE CLEANER

(75) Inventor: Zugen Ni, Jiangsu Province (CN)

(73) Assignee: Suzhou Kingclean Floorcare Co., Ltd., Suzhou (CN)

( * ) Notice: Subject to any disclaimer, the term of this patent is extended or adjusted under 35 U.S.C. 154(b) by 0 days.

(21) Appl. No.: 12/289,754

(22) Filed: Nov. 3, 2008

(65) Prior Publication Data

US 2009/0145993 A1 Jun. 11, 2009

(30) Foreign Application Priority Data

Dec. 10, 2007 (CN) ..... 2007 1 0191548

(51) Int. Cl.
*B65H 75/30* (2006.01)

(52) U.S. Cl. ..... 242/395.1; 242/405.2; 242/405.3; 74/547

(58) Field of Classification Search ..... 242/395.1, 242/284, 405.2–405.3, 588.2; 74/547, 551.3, 74/554

See application file for complete search history.

(56) References Cited

U.S. PATENT DOCUMENTS 1,247,911 A * 11/1917 walkup ..... 74/547
2,455,819 A * 12/1948 Smith ..... 242/395.1
4,581,497 A * 4/1986 Morrison et al. ..... 191/12.2 R
4,768,546 A 9/1988 Brusadin et al.
5,056,553 A 10/1991 Whitehead et al.
5,308,011 A 5/1994 Roman
5,421,533 A 6/1995 Scott et al.
5,566,901 A 10/1996 Wilder
6,299,095 B1 * 10/2001 Murfin ..... 242/395
6,398,148 B1 * 6/2002 Snow ..... 242/395.1
6,557,792 B1 * 5/2003 Snow ..... 242/395.1
6,648,257 B2 * 11/2003 Lu ..... 242/284
6,908,058 B2 6/2005 Moon et al.
6,921,060 B2 * 7/2005 Weed, Jr. ..... 254/266
7,017,603 B1 3/2006 Rosine et al.
7,316,368 B2 1/2008 Moon et al.
7,575,188 B2 * 8/2009 Mullen et al. ..... 242/405.2

* cited by examiner

*Primary Examiner*—Sang Kim
(74) *Attorney, Agent, or Firm*—Birch, Stewart, Kolasch & Birch, LLP

(57) ABSTRACT

A rotating apparatus for a winding reel of a high-pressure cleaner, including a rotating wheel with a slideway, a slider and a handle mounted on the slider, said slider slides in the slideway, the slider has a first working position that fixes the entire slider in the rotating wheel and a second working position that makes the slider partly in the rotating wheel. When the slider is at the second working position, the arm of force is increased without occupying more space. When the rotating apparatus is not in use, the handle is placed in concave portion. Compared with conventional rotating apparatuses, the rotating apparatus is foldable, occupies less space, makes the whole body of the high-pressure cleaner beautiful, convenient to operate, and suitable for popularizing with high-pressure cleaners, and with similar devices.

11 Claims, 10 Drawing Sheets

ROTATING APPARATUS FOR WINDING REEL OF HIGH-PRESSURE CLEANER

FIELD OF THE INVENTION

This invention relates to a rotating device, particular to a rotating apparatus for winding reel of high-pressure cleaner.

BACKGROUND INFORMATION

High-pressure cleaner or similar appliance is provided with a rotating apparatus for a winding reel on its housing, in the use of such apparatus, the rotating wheel is held by rotating the handle, and the portion of the rotating wheel in the housing is connected to the winding reel, which can wind or unwind line and hose by a certain structure, however, the handle of the rotating apparatus for a high pressure cleaning appliance or similar appliance is directly coupled to the rotating wheel, taking in to account of the arm of force, the diameter of the rotating wheel should be long enough to make the handle far enough from the rotating axis of the rotating wheel, resulting the rotating apparatus obtrusive on the housing, not only occupying a large space but also not very effort with the limit of the diameter of the rotating wheel.

SUMMARY OF THE INVENTION

The object of the invention is to provide a rotating apparatus, which increases the arm of force of the force applied to the handle in order to save effort and reduces the volume of the rotating apparatus.

TECHNICAL SOLUTION OF THE INVENTION

A rotating apparatus for a winding reel of a high-pressure cleaner, comprising a rotating wheel with a slideway, a slider and a handle mounted on the slider, said slider is mounted in the slideway, and the slider can slide in the slide way, the slider has a first working position that the slider is entirely in the rotating wheel and a second working position that a part of said slider extends beyond the rotating wheel. The connection relation between the handle and the slider is not limited, the handle can be integrated from the slider, and alternatively, the handle can be separated from the slider as a usual technic.

Said slider is provided with a convex rib extending downward from a bottom end thereof, and the slideway is provided with a first side wall corresponding to the convex rib, when the slider is in the first working position, the convex rib is butting against the first side wall preventing the slider from sliding out of the slideway. A second side wall for corresponding with convex rib is disposed in the slideway in order to prevent the slider sliding out at the second working position.

Alternatively, the following technical solution could be applied: one end of the slider is designed to be bigger than the other one, and the width of the both ends of the slideway are relatively narrower than the middle portion of the slideway that keeps the whole body of the slider in the slideway at the first working position and keeps a part of the slider in the slideway.

A more preferred technical solution is: the slider is provided with a convex rib on its bottom, and the slideway is provided with a first side wall corresponding to the convex rib, when the slider is in the first working position, the convex rib is butting against the first side wall preventing the slider from sliding out of the slideway; Said slider is provided with a location hole; the slideway is provided with a stop pin which is held by a resilient member and can be stuck in the location hole of the slider for fixing the slider at the second working position. Comparing with the foregoing technical solutions, this slideway comprises a stop pin for fixing the slider and preventing the slider from moving backward. Obviously, this technical means can coexist with the foregoing technical solutions, said slideway has a side wall rib for corresponding with the convex rib, and said convex rib is butting against the second side wall for preventing the slider from sliding out of the slideway, when the slider is at the second working position, the slider is fixed steadily under the combined action of the second side wall and the stop pin.

The stop pin in this invention is held by a resilient member in the slideway, a moveable connection between the handle and the slider is preferred, the slider further has a concave for receiving the handle, and said location hole is disposed at a bottom of the concave, a locking engagement part is disposed in the concave upon the location hole extending towards the location hole, a snap-fit element suitable for being engaged with the locking engagement part is arranged at the end of the handle, when the handle rests in the concave, the rear part of the handle pushes the stop pin downward and is separated from the location hole with the resilient member being compressed and finally the locking engagement part locks a rear part of the handle for further fixing the handle in the concave, in this way, the slider are released from the second working position, and the apparatus occupying less space.

The handle is preferably coupled to the slider via a pivot, said slider has a connecting end portion extending upward thereof, which is provided with a pivot hole capable of receiving the pivot and the handle has a lower end portion, which has a recess at each side thereof the pivot for receiving the ends of the pivot with aligning with the pivot hole. Said pivot hole is a longitudinal hole, which allows a vertical movement of the pivot, a spring is positioned above the pivot in a receiving hole inside the connecting end portion, a spring is positioned above the pivot in a receiving hole inside the connecting end portion, said spring elastically urges the pivot toward a bottom of the pivot hole; said handle is provided with a flange corresponding to a groove of the connecting end portion, said groove is above the spring for engaging with the flange. After the flange getting stuck in the groove, because of the pressure applied to the pivot from the spring, the pivot further draws the handle downwardly so as to secure the handle in a perpendicular to the slider, and ensures the reliable connection between the handle and the slider in normal use.

Another objective of the invention is to provide a high-pressure cleaner with an above-mentioned rotating apparatus for winding reel, the cleaner comprises at least one hose or one power suppler line, at least one winding reel for reeling said hose or power suppler line and a rotating apparatus, the rotating wheel of the rotating apparatus is supported by a plurality of shores disposed under the rotating wheel, said slideway of the rotating wheel has a elongated groove with a plurality of via holes, said rotating wheel has recess holes corresponding to the shores and a locking hole corresponding to the via hole. The top edges of the slideway extend toward each other in order to keep the slider in the slideway. With the combination of the rotating apparatus and the winding reel, a power supply line or a hose could be reeled easily, during no-use, the handle is placed in the concave of the slider, in this way, and the apparatus occupies less space.

THE ADVANTAGES OF THE INVENTION

1. The rotating apparatus of this invention, of which the rotating wheel is provided with a slider sliding in the sideway, one end of the slider is fixed during use, and the other end coupled to the handle protrudes out of the slideway, that increases the arm of force without occupying more space.

2. The rotating apparatus of this invention, of which the slider is placed in the concave. Comparing with the existing rotating apparatus, said rotating apparatus is foldable, occupies less space, makes the whole body of the cleaner beautiful and simply with convenient operation, and suitable for popularizing in the high-pressure cleaner or similar apparatus.

THE PRESENT INVENTION WILL BE FURTHER DESCRIBED IN CONJUNCTION WITH THE DRAWINGS AND THE EMBODIMENTS

DETAILED DESCRIPTION OF THE PREFERRED EMBODIMENT

Figure 1:
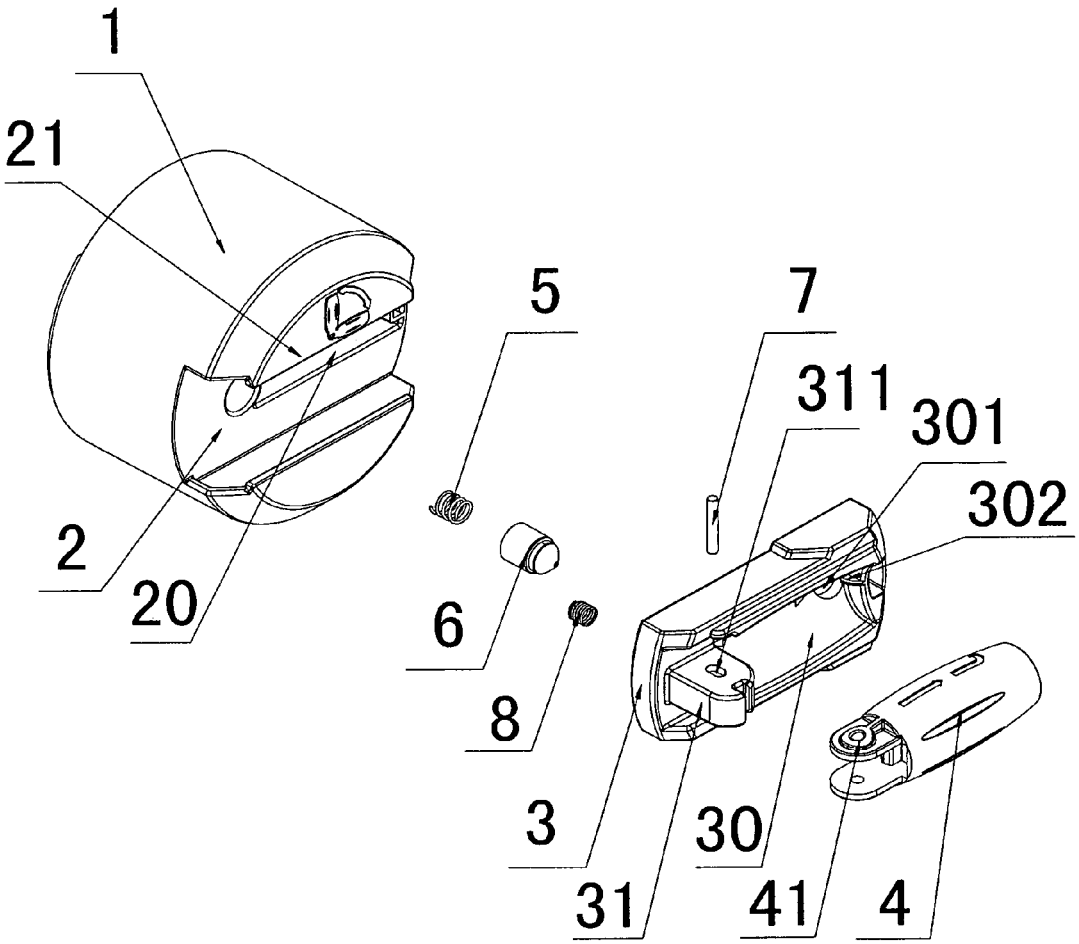
FIG. 1 is the exploded view of the rotating apparatus of this invention.
Figure 2:
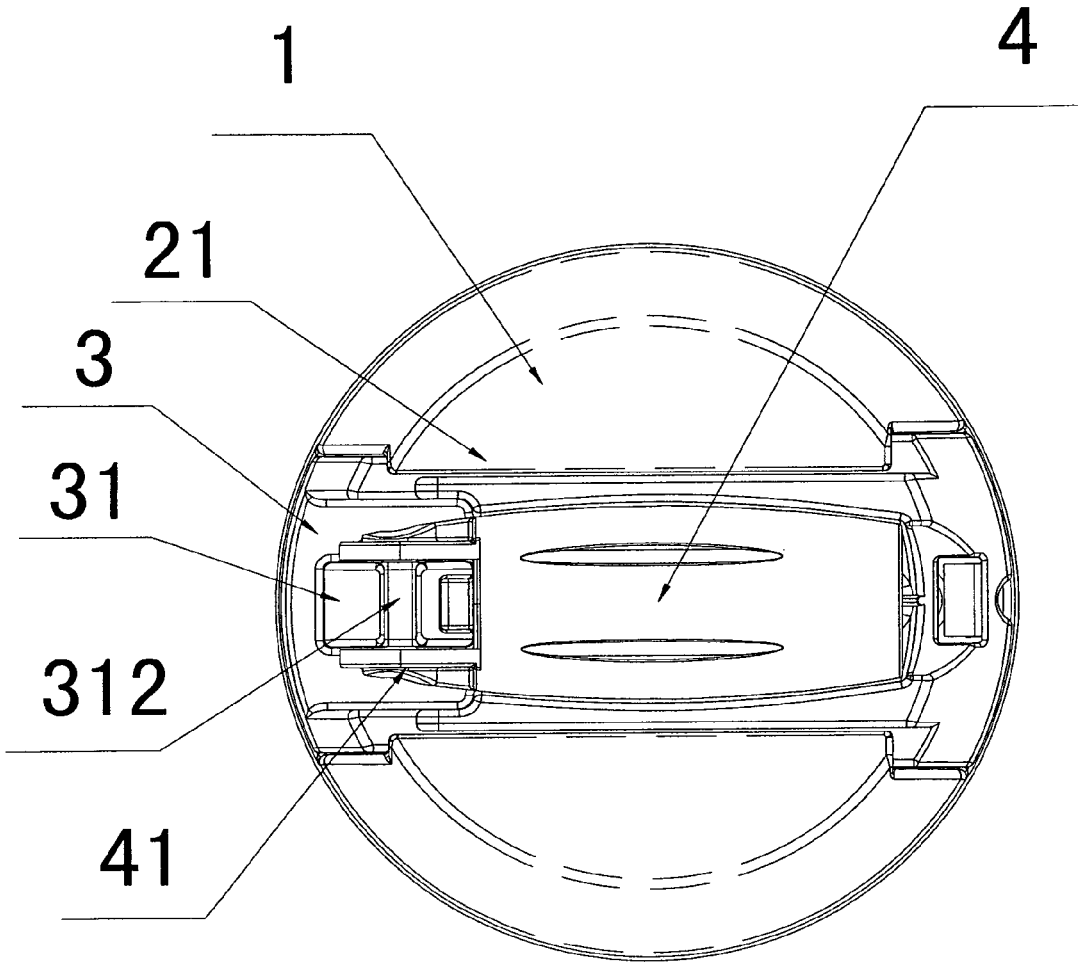
FIG. 2 is the top view of the rotating apparatus of this invention.

A detailed embodiment of a rotating apparatus for winding reel of high-pressure cleaner as shown in FIG. 1, FIG. 2, FIG. 3, FIG. 4, FIG. 5 and FIG. 6, said rotating apparatus comprises a rotating wheel 1, a slider 3, a handle 4, a pivot 7, a spring 8, a resilient member 5 and a stop pin 6. Said rotating wheel 1 is provided with a slideway 2, the slider 3 is mounted in the slideway 2 and has two working position: a first working position that the slider 3 is entirely in the rotating wheel 1 and a second working position that the slider 3 is partly in the rotating wheel.

In this embodiment, the top edges 21 of the slideway 2 extend toward each other in order to keep the slider 3 in the rotating wheel. Said slider 3 is provided with a convex rib 32 on its bottom, and the slideway 2 is provided with an elongated groove 20 having a first side wall 201 corresponding to the convex rib 32, when the slider 3 is located at the first working position, the convex rib 32 is abutting against the first side wall 201 for preventing the slider 3 from sliding out of the slideway 2; A second side 202 wall for corresponding with convex rib 32 is disposed in the slideway 2 in order to prevent the slider 3 sliding out of the slideway 2 at the second working position.

The slider 3 of this embodiment is provided with a location hole 301, the slideway 2 is inserted with a stop pin 6 held by a resilient member 5, said stop pin 6 has a cavity capable for receiving the resilient member 5, and the bottom of the resilient member 5 is coupled to a bottom of a hole in the slideway. Said stop pin 6 can be stuck in said location hole 301 by the movement of the slider 3 in the slideway 2 and fixed the slider 3 at the second working position, the slider 3 is fixed steadily under the combined action of the second side wall 202 and the stop pin 6, and the stop pin 6 further prevent the slider 3 from recession.

The handle 4 in this embodiment is coupled to the slider 3 with a pivot 7, and a convex part 31 of the slider 3 is the connecting end portion, said convex part 31 is provided with a pivot hole 311 capable of receiving the pivot 7 and the handle 4 has a connecting end portion, which has a recess 41 at each side of the pivot for receiving the ends protruding outwards from the pivot hole 311. Said pivot hole 311 is a longitudinal hole, which enables vertical movement of the pivot 7. Meanwhile, the bottom of said convex part 31 is open, and said convex part 31 has a cavity 313 inside; a hole 314, in which the spring 8 fits, opens into the underside cavity 313, and a spring 8 is set in the hole 314, meanwhile the spring 8 is placed upon the pivot 7 in the pivot hole 311, said spring 8 retains the pivot 7 on the bottom of the pivot hole 311. In the procedure of setting, the spring 8 should be set in the hole 314 before the pivot 7 is inserted through the pivot hole 311.

Said connecting end portion of the handle 4 in this embodiment is provided with a flange 42, and the corresponding portion to the connecting end portion of the slider is provided with a groove 312 for receiving said flange 42, said groove 312 is disposed upon the spring 8. After the flange 42 getting stuck in the groove 312, because of the pressure applied to the pivot from the spring 8, the pivot 7 further draws the handle 4 downwardly so as to secure the handle 4 in a perpendicular to the slider 3, and ensures the reliable connection between the handle 4 and the slider 3 in normal use.

The slider further has a concave 30 for receiving the handle 4, and said location hole 301 is disposed in the concave 30, a locking engagement part 302 is disposed in the concave 30 upon the location hole 301 extending towards the location hole 301, a snap-fit element suitable for being engaged with the locking engagement part 302 is arranged at the end of the handle 4. When the handle 4 rests in the concave 30, the rear part of the handle 4 pushes the stop pin 6 out of the location hole 301 and the locking engagement part 302 locks the snap-fit element of the handle 4 and further fixes the handle 4, in this way, the slider 3 recesses from the second working position.

The assembly process of this embodiment is: Firstly, insert the resilient member 5 into the hole of the rotating wheel 1, and envelop the stop pin 6 on the resilient member 5, and then push the slider 3 from the end having the elongated groove 20 to the end having the stop pin 6, with the restriction of the top edges 21 of the slideway 2, the slider 3 moves along the slideway 2, but is unable to get out of the slideway 2. When the slider 3 reaches the hole for receiving the stop pin, the slider 3 presses on the stop pin 6, makes the resilient member shrink and enables the slider passes the hole with out barrier, the slider 3 moves on until the convex rib 32 of the slider 3 butts against the brim of the rotating wheel 1, the force applied to the slider at the motion direction should be increased to force the convex rib 32 to be distorted to be stuck in the elongated groove 20, when the slider 3 is fully in placed, because the slider 3 has a shallow hole (as shown in FIG. 4, the top of the stop pin 6 is in the shallow hole), the top of the stop pin 6 is in the shallow.

Figure 7:
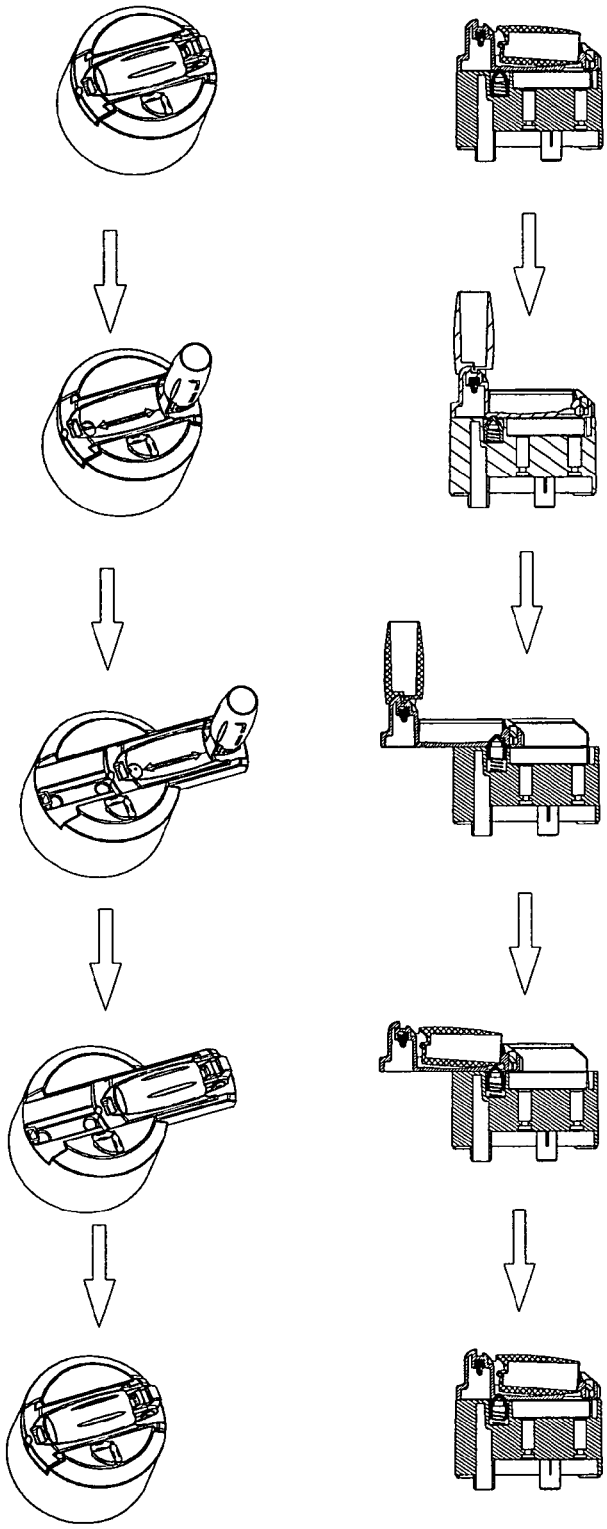
FIG. 7 is the sketch view of the operation demo of the rotating apparatus.

The working process of the rotating apparatus for winding reel of high-pressure cleaner will be description in combination with FIG. 7. When rotating apparatus 1 is in the state of collapse, the handle 4 rests in the concave 30 of the slider 3; Pivot the handle 4 and push the slider outward to start using, when the location hole 301 of the slider 3 faces to the stop pin 6 held by the resilient member 5, the sop pin 6 is stuck into the location hole 301 and fixes the slider 3 at the second working position; After use, the handle 4 is furled into the concave 30, the back end 40 of the handle push the stop pin 6 out of the location hole 301, and release the slider 3 from the second working position, lastly, push the slider 3 in to the rotating wheel 1 along the slideway 2 back to the first working position.

Figure 8:
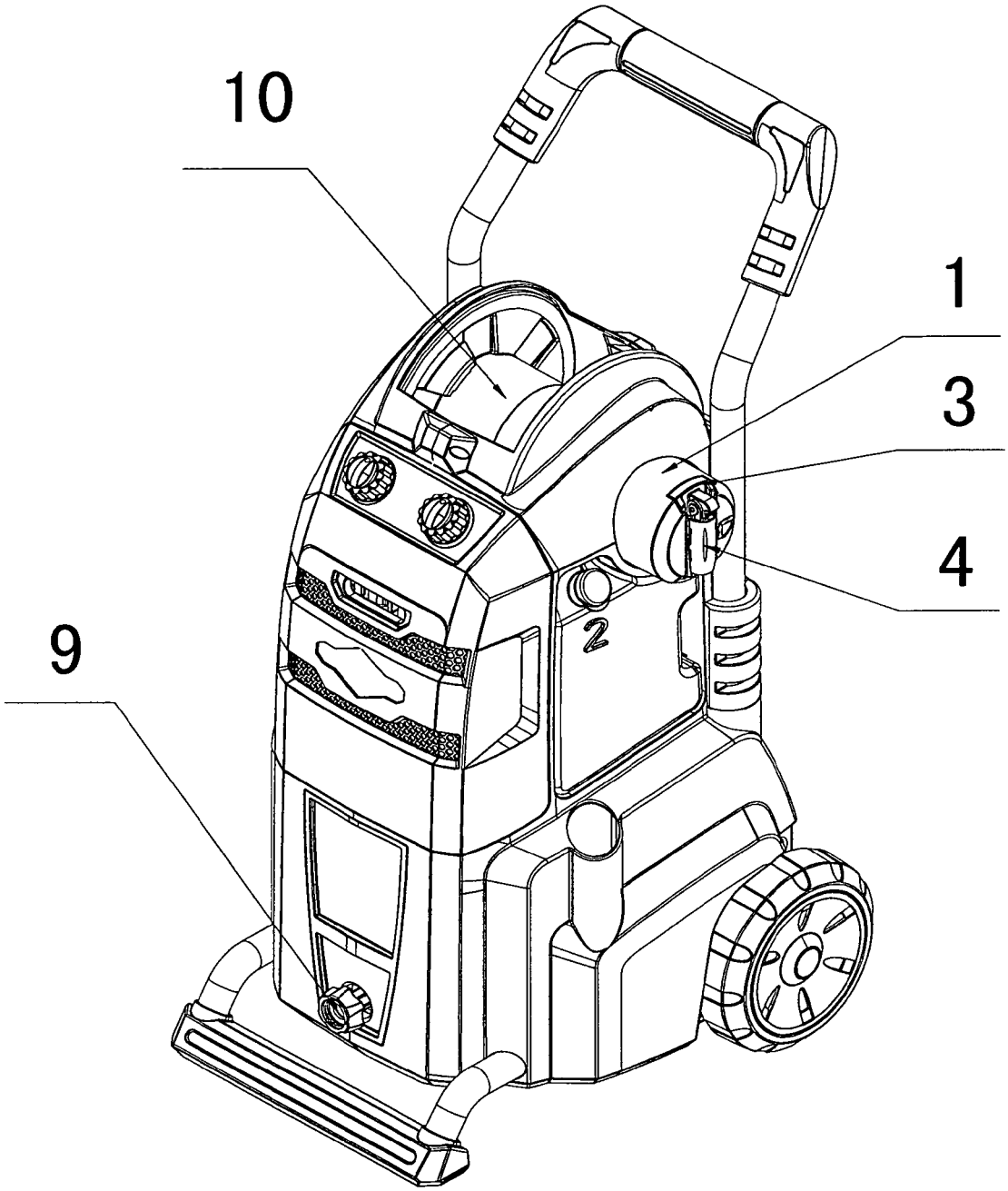
FIG. 8 is the sketch view of a high-pressure cleaner with a rotating apparatus of this invention.
Figure 9:
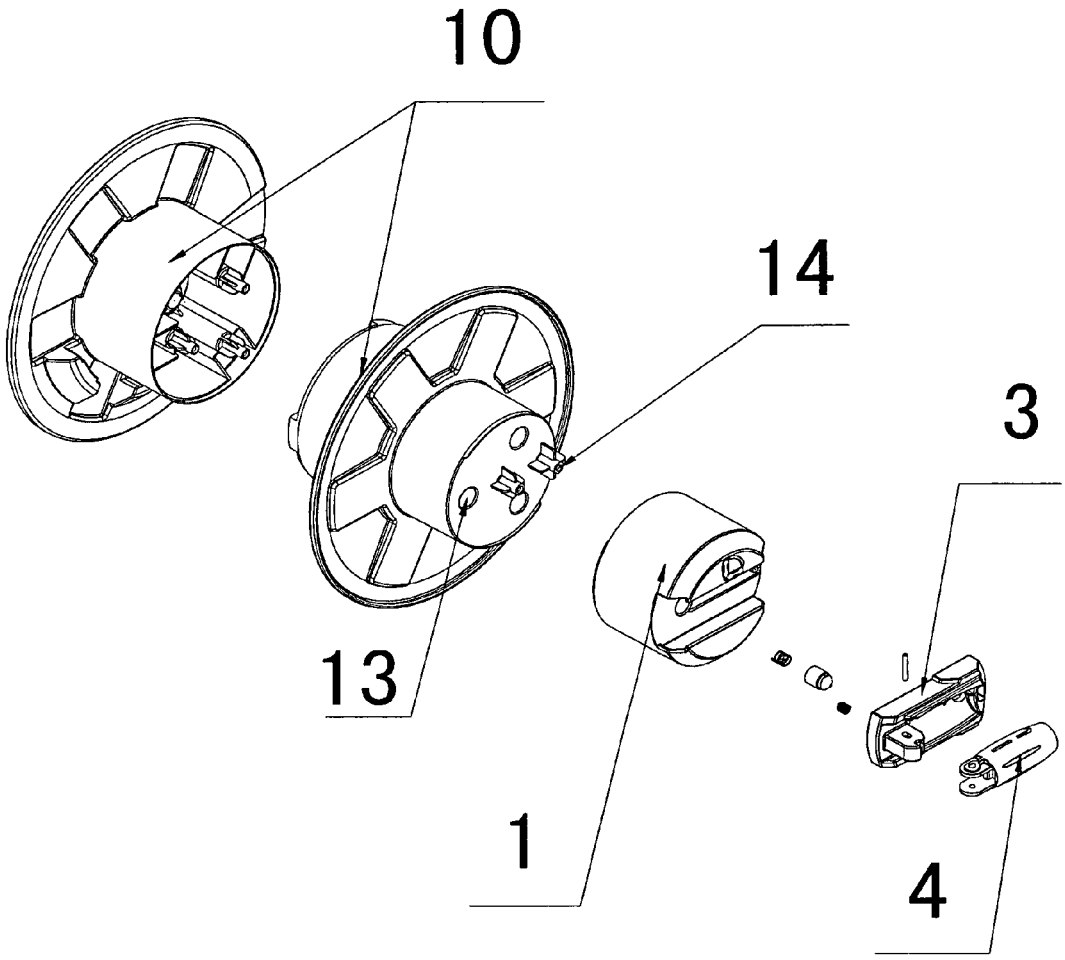
FIG. 9 is the exploded view of the rotating apparatus and the winding reel of this invention.
Figure 10:
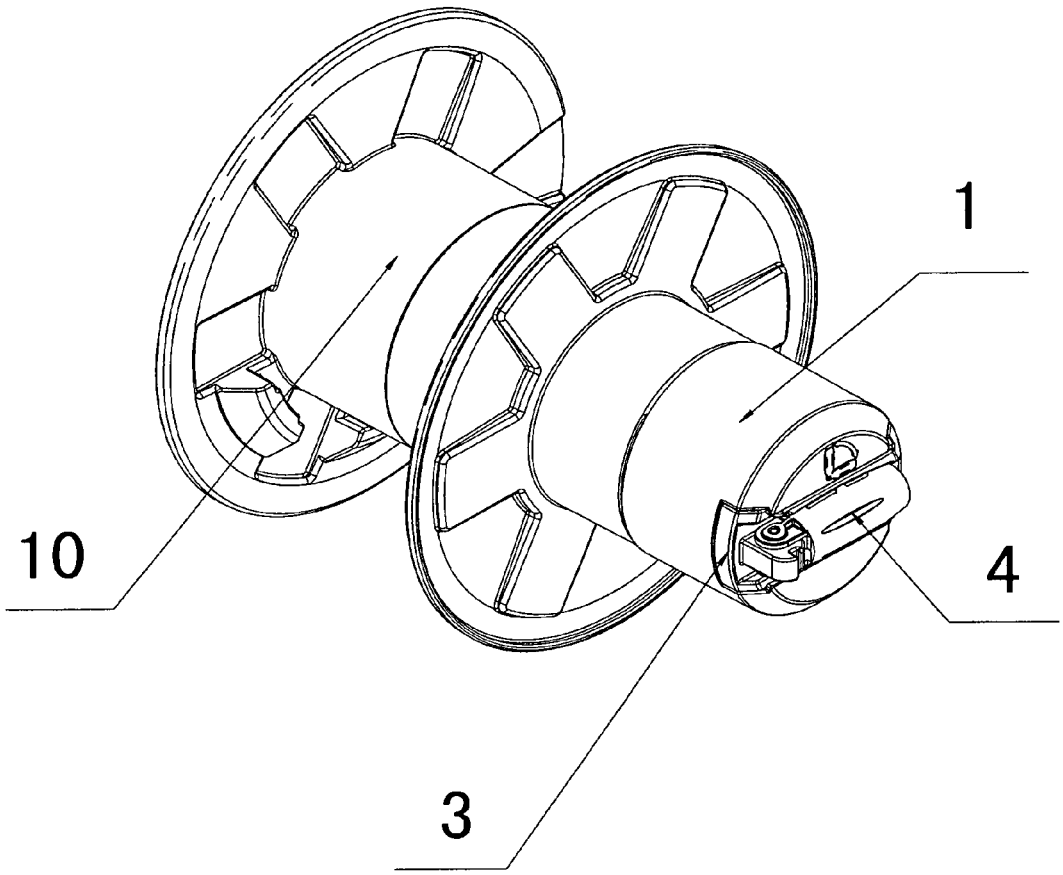
FIG. 10 is the assembly view of the rotating apparatus and the winding reel of this invention.

A high-pressure cleaner as shown in FIG. 8 installed with a rotating apparatus described in the above-mentioned embodiment. The high-pressure cleaner comprises a hose 9, a winding reel for reeling hose 9 and a rotating apparatus; said winding reel is assembled by a left and a right wheel with bolt holes.

Figure 3:
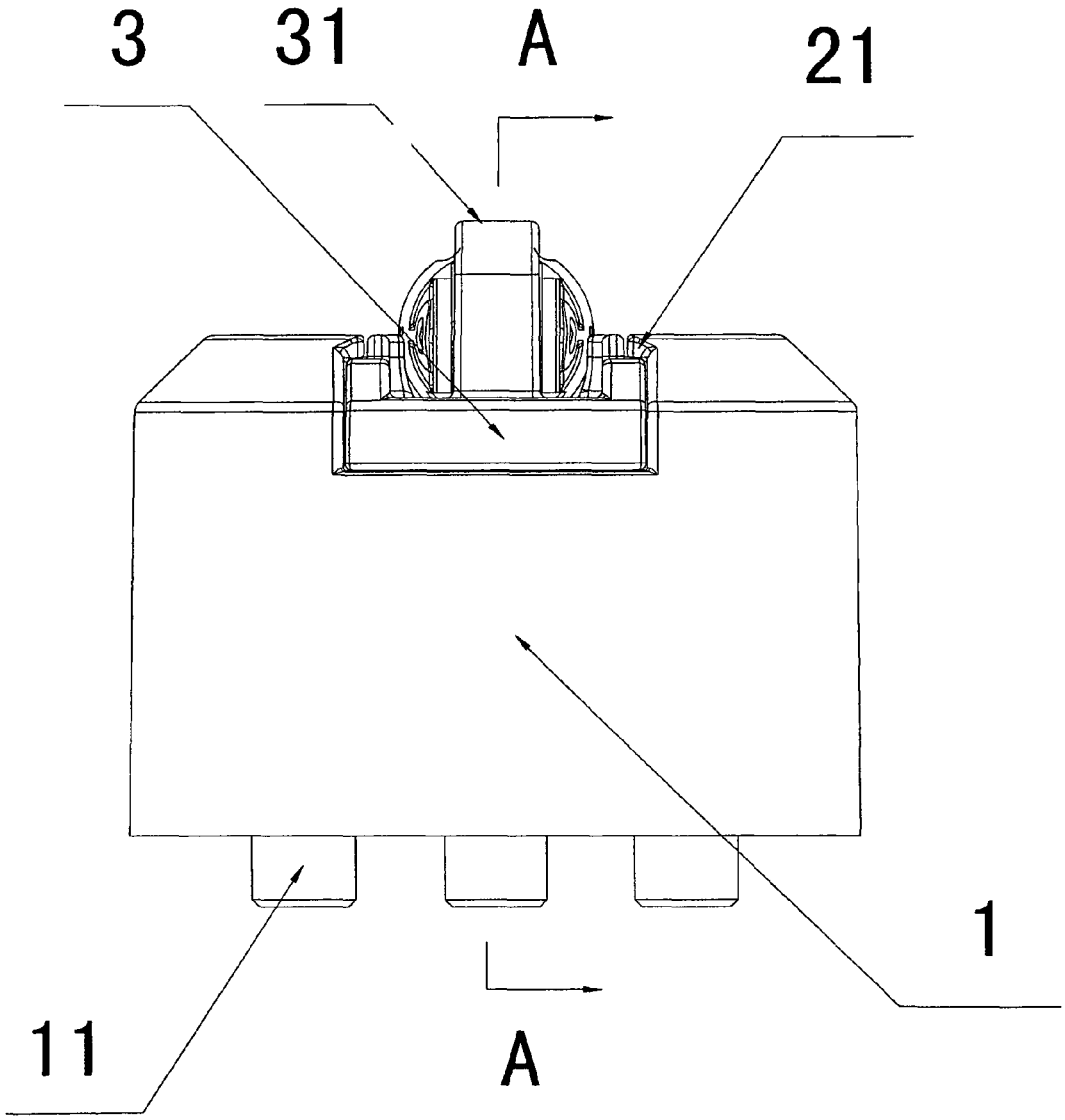
FIG. 3 is the left view of the rotating apparatus of this invention.
Figure 4:
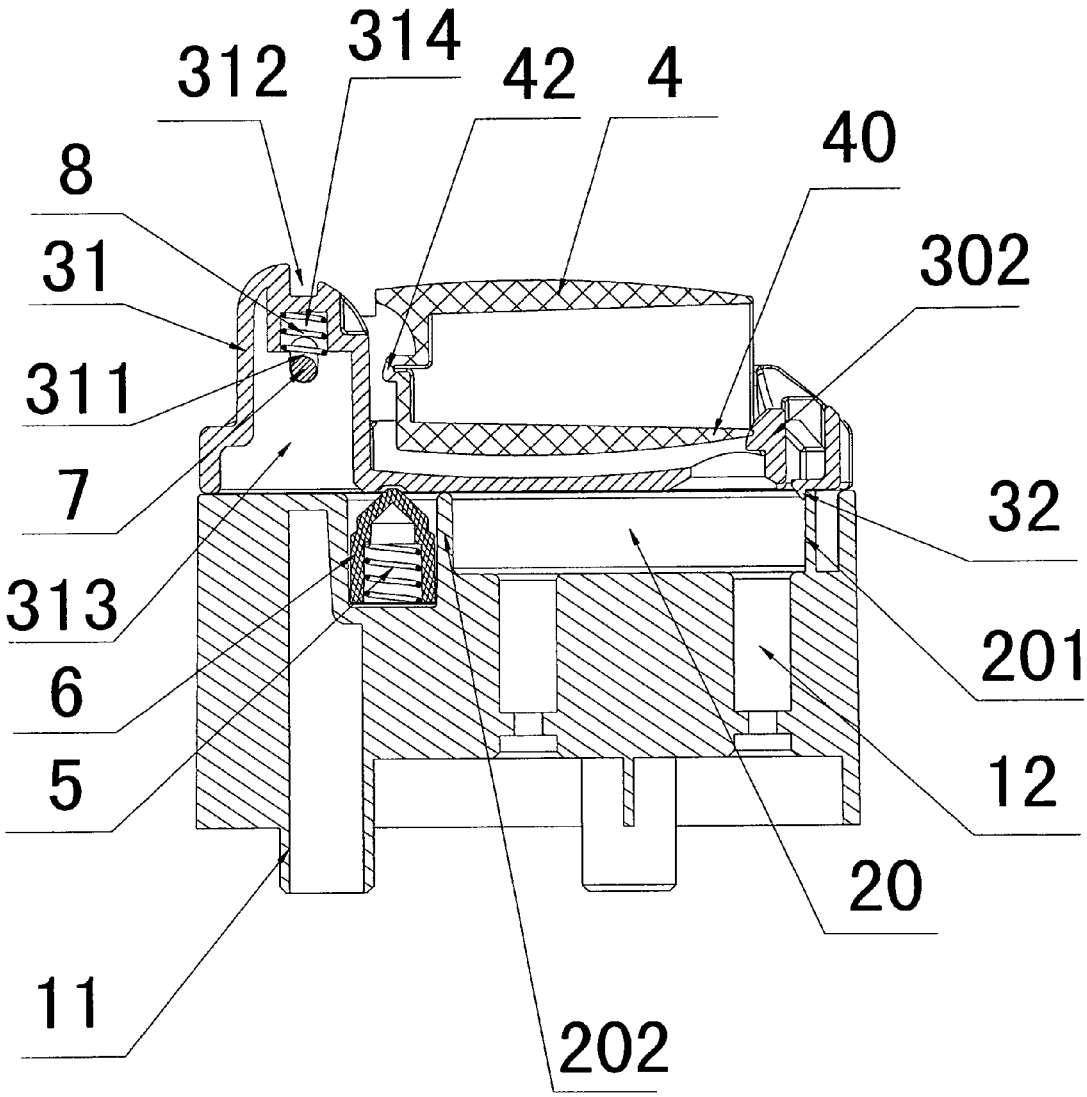
FIG. 4 is the A-A sectional view of FIG. 3.
Figure 5:
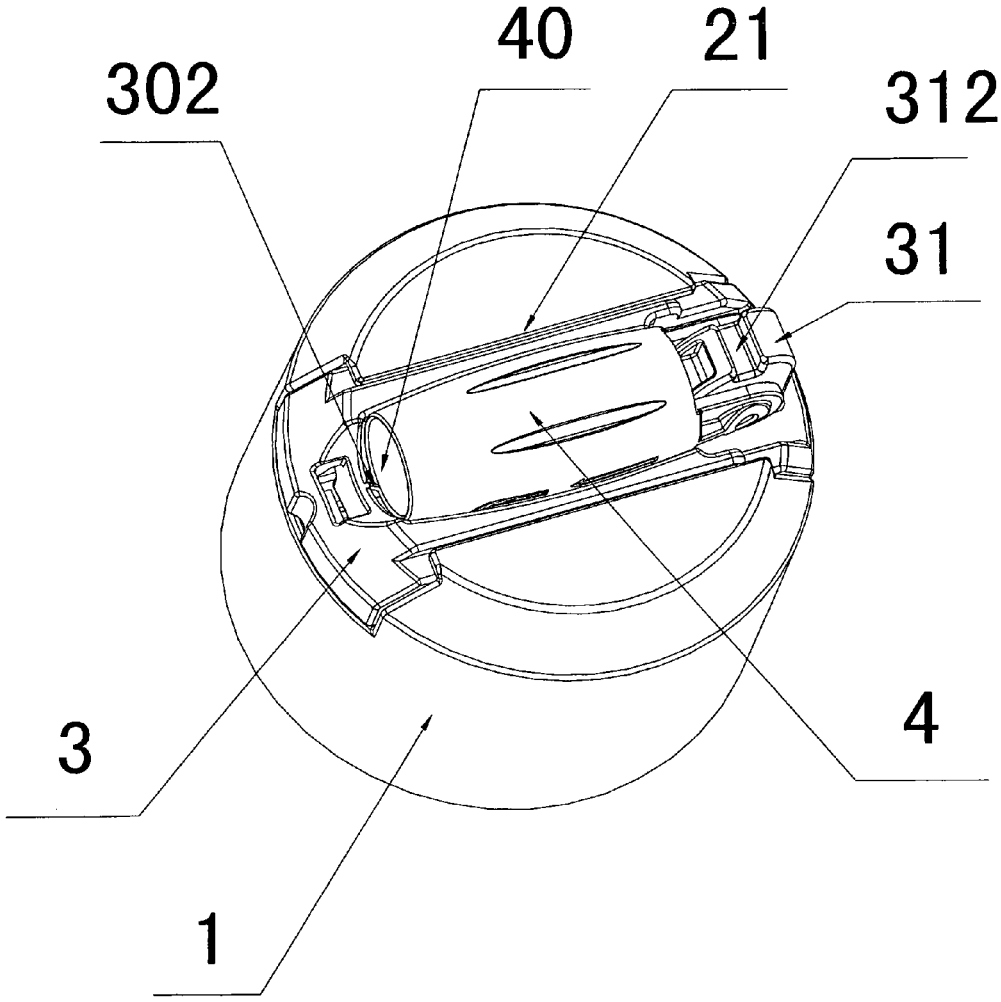
FIG. 5 is the perspective view of the rotating apparatus for a winding reel (the slider located in the first work position)
Figure 6:
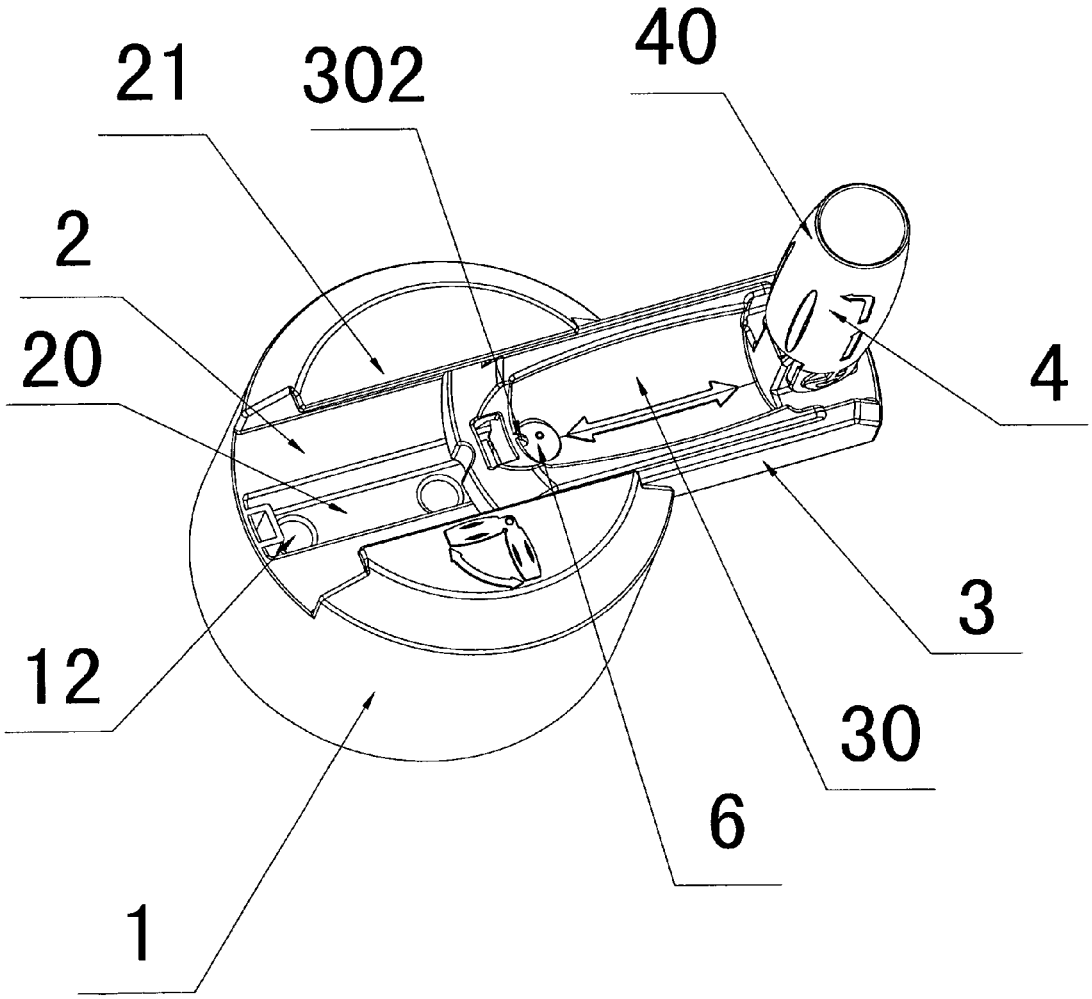
FIG. 6 is the perspective view of the rotating apparatus for a winding reel (the slider located in the second work position)

As FIG. 3, FIG. 4, FIG. 6, shown, the rotating wheel 1 of the rotating apparatus is supported by a plurality of shores 11 disposed under the rotating wheel 1, said slideway 2 of the rotating wheel 1 has a elongated groove 20 with a plurality of via holes 12; said rotating wheel 10 has recess holes 13 corresponding to the shores 11 and a locking hole 14 corresponding to the via hole 12, the combination of the rotating apparatus and the winding reel 10 are assembled easily, a power supply line or a hose could be reeled easily, during no-use, the handle is placed in the concave of the slider, in this way, and the apparatus occupies less space. This high-pressure has at least one hose 9, a plurality of combinations of winding reels 10 and rotating apparatus could be installed to the high-pressure cleaner for reeling hoses 9 or power supply line.

The invention claimed is:

1. A rotating apparatus for a winding reel of a high-pressure cleaner, comprising:

a rotating wheel (1) with a slide way (2), a slider (3) and a handle (4) upon the slider (3), wherein said slider (3) is mounted and slidable in the slide way (2), the slider (3) has a first working position that the slider (3) is entirely in the rotating wheel (1), and a second working position that a part of said slider (3) extends beyond the rotating wheel (1), wherein said slider (3) is provided with a location hole (301), the slide way (2) is provided with a stop pin (6) which is held by a resilient member (5) and able to be stuck in the location hole (301) of the slider (3) for fixing the slider (3) at the second working position, the handle (4) is separated from the slider (3), and the slider (3) has a concave (30) for receiving the handle (4), and said location hole (301) is disposed at a bottom of the concave (30).

2. The rotating apparatus for a winding reel of a high-pressure cleaner of claim 1, wherein the handle (4) is coupled to the slider (3) with a pivot (7), said slider (3) has a connecting end portion (31) having a cavity (313) inside and extending upward thereof, which is provided with a pivot hole (311) capable of receiving the pivot (7) and the handle (4) has a lower end portion, which has a recess (41) at each side thereof for receiving the ends of the pivot (7) with aligning with the pivot hole (311), said pivot hole (311) is a longitudinal hole, which allows a vertical movement of the pivot (7), a spring (8) is positioned above the pivot (7) in a receiving hole inside the connecting end portion, said spring (8) elastically urges the pivot (7) toward a bottom of the pivot hole (311); said handle (4) is provided with a flange (42) corresponding to a groove (32) of the connecting end portion, said groove (312) is above the spring (8) for engaging with the flange (42).

3. The rotating apparatus for a winding reel of a high-pressure cleaner of claim 1, wherein said slider (3) is provided with a convex rib (32) extending downward from a bottom end thereof, and the slideway (2) is provided with a first side wall (201) corresponding to the convex rib (32), when the slider (3) is at the first working position, the convex rib (32) abuts against the first side wall (201) preventing the slider (3) from sliding out of the slide way (2).

4. The rotating apparatus for a winding reel of a high-pressure cleaner of claim 1, wherein a second side wall (202) corresponding with convex rib (32) is disposed in the slide way (2) in order to prevent the slider (3) sliding out of the slide way (2) at the second working position.

5. The rotating apparatus for a winding reel of a high-pressure cleaner of claim 1, wherein one end of the slider (3) is designed to be bigger than the other one, and the width of both ends of the slide way (2) are relatively narrower than the middle portion of the slide way (2) that keeps the whole body of the slider (3) in the slide way (2) at the first working position and keeps a part of the slider in the slide way at the second working position.

6. The rotating apparatus for a winding reel of a high-pressure cleaner of claim 1, wherein a locking engagement part (302) is disposed in the concave (30) upon the location hole (301) extending towards the location hole (301), and when the handle (4) rests in the concave (30), the rear part of the handle (40) pushes the stop pin (6) downward and is separated from the location hole (301) with the resilient member (5) being compressed, and finally the locking engagement part (302) locks a rear part of the handle (40) for further fixing the handle (4) in the concave (30).

7. A high-pressure cleaner comprising:

at least one hose (9) or a power cord;

at least one winding reel (10) for reeling said hose (9) or a power cord; and a rotating apparatus comprising: a rotating wheel (1) with a slide way (2), a slider (3) and a handle (4) upon the slider (3), wherein said slider (3) is mounted and slidable in the slide way (2), the slider (3) has a first working position that the slider (3) is entirely in the rotating wheel (1) and a second working position that a part of said slider (3) extends beyond the rotating wheel (1), wherein said slider (3) is provides with a location hole (301), the sled way (2) is provided with a stop pin (6) which is held by a resilient member (5) and is able to be stuck into the location hole (301) of the slider (3) for fixing the slider (3), the slider (3) has a concave (30) for receiving the handle (4), and said location hole (301) is disposed at a bottom of the concave (30).

8. The high-pressure cleaner of claim 7, wherein the top edges (21) of the slide way (2) extend toward each other in order to keep the slider (3) in the slide way (2).

9. The high-pressure cleaner of claim 7, wherein the rotating wheel (10) of the rotating apparatus is supported by a plurality of shores (11) disposed under the rotating wheel (1), said slide way (2) of the rotating wheel (1) has a elongated groove (20) with a plurality of through holes (12), said rotating wheel (10) has recess holes (13) corresponding to the shores (11) with each through hole (12) corresponding to a locking hole (14).

10. The rotating apparatus for a winding reel of a high-pressure cleaner of claim 7, wherein a locking engagement part (302) is disposed in the concave (30) upon the location hole (301) extending towards the location hole (301), and when the handle (4) rests in the concave (30), the rear part of the handle (40) pushes the stop pin (6) downward and is separated from the location hole (301) with the resilient member (5) being compressed, and finally the locking engagement part (302) locks a rear part of the handle (40) for further fixing the handle (4) in the concave (30).

11. The rotating apparatus for a winding reel of a high-pressure cleaner of claim 7, wherein the handle (4) is coupled to the slider (3) with a pivot (7);

said slider (3) has a connecting end portion (31) having a cavity inside and extending upward thereof, which is provided with a pivot hole (311) capable of receiving the pivot (7) and the handle (4) has a lower end portion which ahs a recess (41) at each side thereof for receiving ends of the pivot (7) aligning with the pivot hole (311), said pivot hole (311) is a longitudinal hole which allows a vertical movement of the connecting end portion, said spring (8) elastically urges the pivot (7) toward a bottom of the pivot hole (311);

said handle (4) is provided with a flange (42) corresponding to a groove (312) of the connecting end portion, and said groove (312) is above said spring (8) for engaging the flange (42).

* * * * *